United States Patent [19]

Blatter

[11] 4,351,781

[45] Sep. 28, 1982

[54] TERRACED WATER DISTRIBUTOR FOR EVAPORATIVE AIR CONDITIONER

[75] Inventor: Kenneth F. Blatter, Phoenix, Ariz.

[73] Assignee: Dresser Industries, Inc., Dallas, Tex.

[21] Appl. No.: 280,601

[22] Filed: Jul. 6, 1981

Related U.S. Application Data

[63] Continuation of Ser. No. 140,039, Apr. 14, 1980, abandoned.

[51] Int. Cl.[3] ..... B01F 3/04

[52] U.S. Cl. ..... 261/29; D23/145; D23/146; 62/310; 62/314; 239/193; 261/97; 261/106; 261/DIG. 3

[58] Field of Search ..... 261/29, 97, 103, 106, 261/110, 112, DIG. 3, DIG. 4, DIG. 44; 98/2.11, 2.14; 62/314–316, 310, DIG. 16; D23/141, 145, 146; 239/17, 193, 194

[56] References Cited

U.S. PATENT DOCUMENTS

| | | | |
|---|---|---|---|
| 2,319,565 | 5/1943 | Stratton | 261/29 |
| 2,325,692 | 8/1943 | Maddox | 261/29 |
| 2,685,434 | 8/1954 | Underwood | 261/29 X |
| 2,961,226 | 11/1960 | Goettl | 261/29 |
| 3,273,872 | 9/1966 | Eckert | 261/97 X |
| 3,372,911 | 3/1968 | Herboldsheimer | 261/97 X |
| 3,493,216 | 2/1970 | Johnson | 261/112 X |
| 3,867,486 | 2/1975 | Nagele | 261/29 |
| 4,029,723 | 6/1977 | Morrison et al. | 261/29 |
| 4,094,935 | 6/1978 | Walker et al. | 261/DIG. 4 |
| 4,094,936 | 6/1978 | Fernandez-Baujin | 261/97 X |

FOREIGN PATENT DOCUMENTS

| | | | |
|---|---|---|---|
| 52-26046 | 2/1977 | Japan | 261/110 |

*Primary Examiner*—Richard L. Chiesa

[57] ABSTRACT

An evaporative air conditioner is provided which includes a housing (10) having air-pervious portions (12). Wettable pads (20) are mounted within the housing (10) against the inner surface of the air-pervious portions (12) such that ambient air flowing through the air-pervious portions (12) flow through the pads (20). A suction fan (18) is mounted within the housing (10) for drawing ambient air through the air-pervious portion (12). A liquid distributor (16) is mounted above the housing (10). The distributor (16) has surfaces which slope downwrdly from the center of the distributor (16) toward the upper edges of the housing (10). The surfaces of the distributor (16) which slope toward the air-pervious portions (12) of the housing (10) include horizontal terraces (17) for distributing liquid evenly across the surfaces. A pump (22) supplies liquid to the center of the distributor (16) such that the liquid flows downwardly by gravity over the terraced surfaces and directly onto the upper edges of the wettable pads (20).

1 Claim, 4 Drawing Figures

TERRACED WATER DISTRIBUTOR FOR EVAPORATIVE AIR CONDITIONER

This application is a continuation of application Ser. No. 140,039, filed Apr. 14, 1980, now abandoned.

BACKGROUND OF THE INVENTION

1. Field of the Invention

This invention relates to air conditioning apparatus and, more particularly, to a terraced water distributor for an evaporative air conditioner.

2. State of the Art

Evaporative air conditioners generally include an anti-pervious outer housing with porous, air-pervious, wettable pads mounted against the inner surfaces of the housing. A liquid distribution system provides cooling water to the pads to maintain them in saturated condition. Hot, dry ambient air is drawn through the saturated pads by a suction fan which is located within the housing. As the hot, dry air comes into contact with the wettable pads, evaporative heat exchange occurs. That is, the ambient air passing through the pads becomes saturated with water vapor. This phenomenon results in cooling of the ambient air by converting the sensible heat of the ambient air to latent heat suspended in the vaporized moisture.

Typically, the water distribution systems of an evaporative air conditioner supplies water to the upper edges of the wettable pads. Water then flows downwardly through the pads to saturate them throughout. For example, U.S. Pat. No. 4,029,723 discloses a water distribution system wherein a V-shaped trough is positioned above the upper edges of the wettable pads. The trough has holes formed in it to allow water to trickle from the trough onto the pads. Water is supplied to the trough by a water distribution tube which is mounted on a ledge within the trough. The distribution tube also has holes in it for discharging water into the trough. Water is supplied to the distribution tube by a sump pump which is located in a liquid reservoir formed as part of the base of the air conditioner.

Another type of water distribution system is taught by U.S. Pat. No. 3,867,486. That patent discloses an evaporative air conditioner which utilizes a flat rectangular water distribution tray having a channel which extends around the periphery of the tray. The channel is located above the upper edges of the air conditioner's wettable pads and has holes formed in it for discharging water onto the pads. Formed in the tray are a number of water supply grooves which extend outwardly from a central feed cup to the peripheral channel. The central feed cup is connected by a hose to a sump pump located in a liquid reservoir. The reservoir is formed as a part of the base of air conditioner and supplies water to the feed cup. Water supplied to the peripheral channel drops through the holes in the channel onto the upper edges of the wettable pads to maintain the pads in a saturated condition.

Yet another type of distribution system is taught by U.S. Pat. No. 2,325,692. That patent discloses a cylindrical evaporative air conditioner which utilizes a conical water distributor. The outer edge of the distributor is positioned above the upper edge of the air conditioner's cylindrical wettable pad. A sump pump delivers water from a reservoir formed as part of the base of the air conditioner to a funnel-shaped, perforated outlet which is mounted at the apex of the surface of the distributor.

Water flows downwardly by gravity from the perforated outlet to the edges of the distributor. Water then falls from the edge of the distributor onto the upper edge of the wettable pad.

A still further type of liquid distributor, disclosed in co-pending U.S. patent application Ser. No. 111,612, includes surfaces which slope downwardly from the center of the distributor toward the upper edges of the air conditioner housing. Radial grooves are formed in the surfaces of the distributor which slope toward the air-pervious portions of the housing. A pump supplies liquid to the distributor such that liquid flows by gravity through the radial grooves and directly onto the upper edges of the wettable pads.

SUMMARY OF THE INVENTION

An evaporative air conditioner is provided which includes a housing having air-pervious portions. Porous, air-pervious wettable pads are mounted within the housing against the inner surface of the air-pervious portions such that air flowing through the air-pervious portions flows through the wettable pads. A suction fan is mounted within the housing for drawing air through the air-pervious portions. A liquid distributor is mounted above the housing. The distributor includes surfaces which slope downwardly from the center of the distributor toward the upper edges of the housing. The surfaces of the distributor which slope toward the air-pervious portions of the housing have horizontal ridges or terraces formed thereon. A pump supplies liquid to the center of the distributor such that the liquid flows by gravity over the terraced surfaces and directly onto the upper edges of the wettable pads.

A BRIEF SUMMARY OF THE DRAWINGS

A DESCRIPTION OF THE PREFERRED EMBODIMENT

Figure 2:
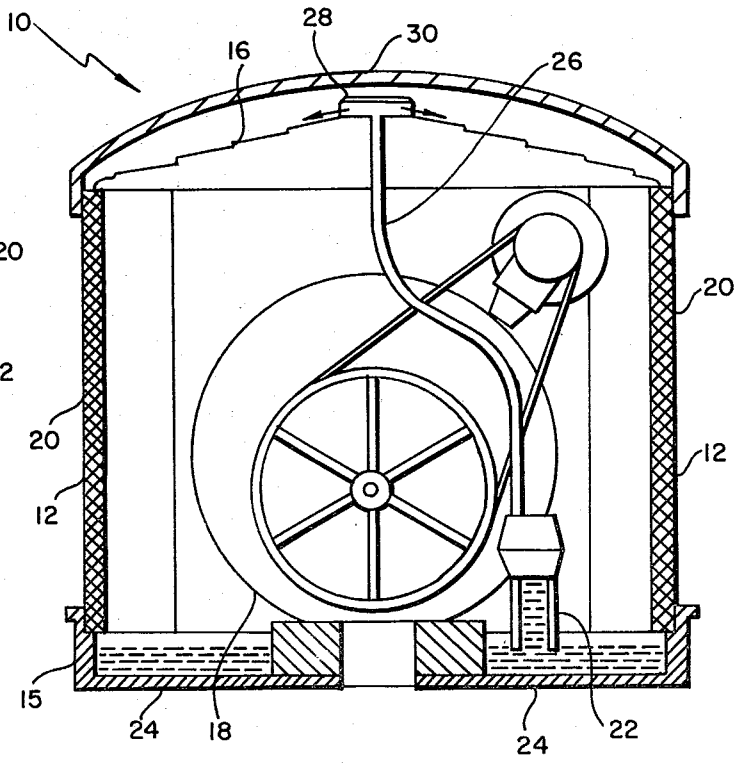
FIG. 2 is a partially cut-away cross-section view of the air conditioner shown in FIG. 1.
Figure 1:
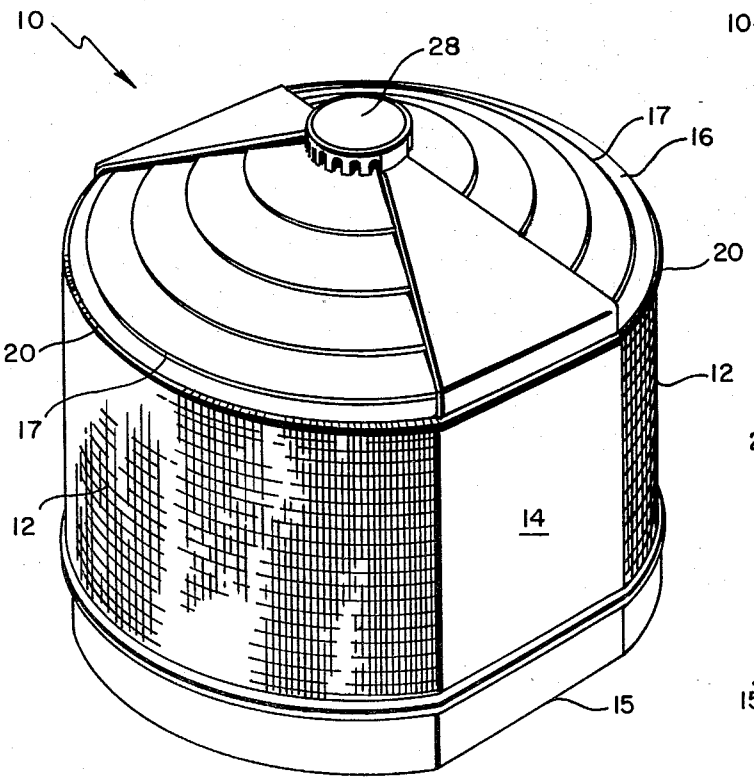
FIG. 1 is a prospective view illustrating an air conditioner with its cover removed to show a liquid distributor according to the present invention.

FIG. 1 illustrates an evaporative air conditioner which comprises a housing 10 having air-pervious portions 12. In the illustrated embodiment, the housing 10 comprises two curved, air-pervious inlet panels 12 and two flat, air-impervious side panels 14. As shown in FIG. 2, porous, air-pervious, wettable pads 20, preferably aspen pads, are mounted against the inner surface of the air-pervious panels 12 such that substantially all air flowing into the housing 10 flows through the wettable pads 20.

A liquid distributor 16 is mounted above the housing 10. The distributor 16, preferably a unitary structure, includes surfaces which slope downwardly from the center of the distributor 16 toward the upper edges of the housing 10. The surfaces of the distributor 16 which slope toward the air-pervious panels 12 of the housing 10 have horizontal ridges or terraces 17 formed thereon. The terraces provide uniform liquid flow across the width of the terraced surfaces such that the wettable pads 20 receive a substantially uniform flow of liquid over their upper edges.

Figure 4:
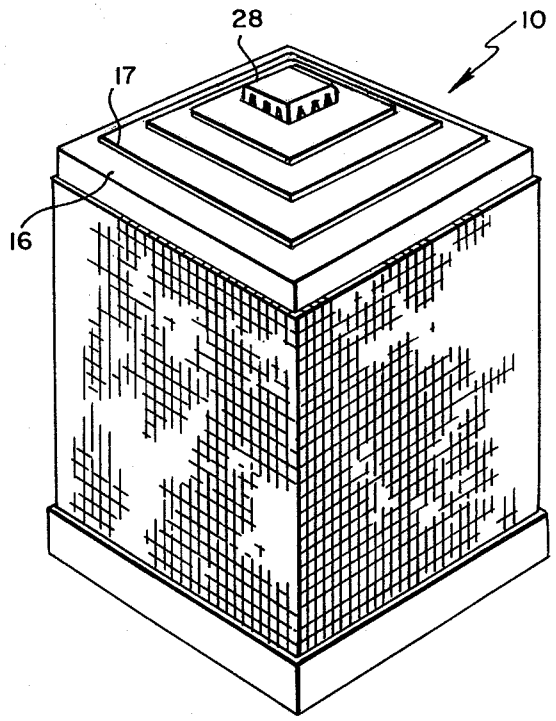
FIG. 4 illustrates a second alternative embodiment of the liquid distributor of the present invention.
Figure 3:
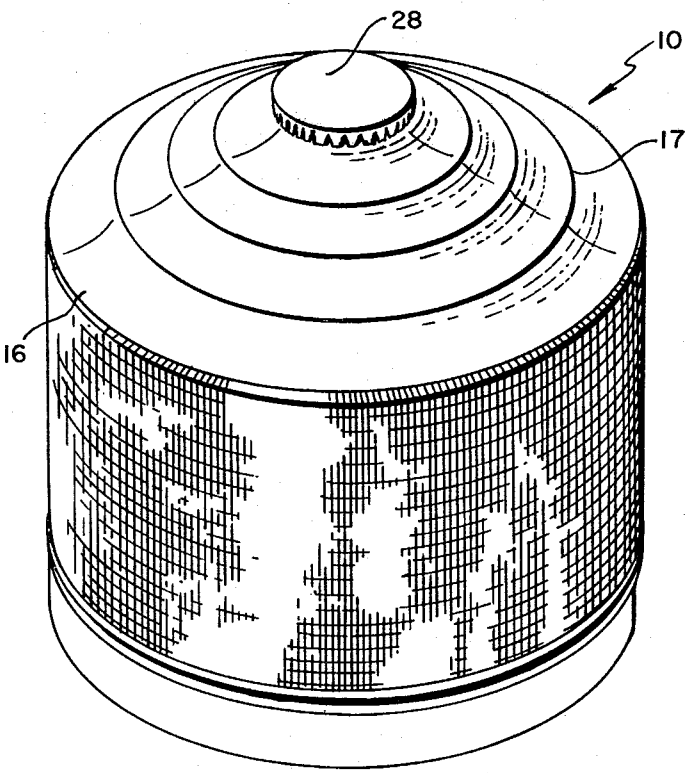
FIG. 3 illustrates an alternative embodiment of the liquid distributor of the present invention.

In the illustrated embodiment, the distributor 16 is generally pyramidal in shape, the base of the pyramid being semi-circular on two of its sides such that the edges of the distributor 16 correspond to the upper edges of the housing 10. It should be understood, however, that the distributor can be any of a variety of shapes to correspond to the shape of its associated housing. For example, if the housing is circular as shown in FIG. 3, then the distributor 16 can be conical and may have concentric ridges or terraces 17 formed about its entire circumference. If the housing is square or rectangular as shown in FIG. 4, then the distributor 16 can be pyramidal and may have ridges or terraces 17 formed on each of its downwardly sloping faces.

Referring to FIG. 2, the edges of the terraced surfaces of the distributor 16 are positioned above the upper edges of the wettable pads 20. Formed at the center of the distributor 16 is an inverted cup 28 which deflects water discharging from a supply hose 25 onto the terraced surfaces. Thus, water deflected from the inverted cup 28 onto the terraced surfaces flows over the surfaces, off the edges of the distributor 16, and directly onto the wettable pads 20.

A pump 22 is located in a liquid reservoir 24 formed at the bottom of the housing 10. Pump 22 delivers water from the reservoir 24 to the inverted cup 28 via hose 25. A removable cover 30 is attached to the top of the housing 10.

A suction fan 18 is located within the housing 10 to draw ambient air through the wettable pads 20. The pads 20 serve as evaporative media, cooling the ambient air as it passes through the pads 20 by converting the sensible heat of the ambient air to latent heat suspended and vaporizing the moisture. Fan 18 delivers cooled air to a desired environment, preferably through discharge opening formed in the bottom of the housing 10.

What is claimed is:

1. An evaporative air conditioner comprising:

a. a housing having at least one air-pervious portion about its periphery;

b. at least one wettable pad mounted within said housing against the inner surface of said air-pervious portion such that air flowing through said air-pervious portion flows through said pad;

c. air suction means mounted within said housing for drawing air through said air-pervious portion and pad;

d. a unitary imperforate liquid distributor mounted above said pad having a downwardly sloping distributor surface extending from an upper portion generally central of said housing to a lower edge that is contiguously above the upper edge of the wettable pad, said distributor including a plurality of terraced steps in said distributor surface spaced apart in said sloping direction and extending about the distributor surface in generally parallel relation to the periphery of said housing for affording a cascade flow of liquid from said upper portion to said lower edge; and e. liquid supply means for supplying liquid to the center of said distributor such that said liquid flows downwardly by gravity in a cascading flow over said distributor surface portion and directly onto the entirety of the upper edge of said wettable pad.

* * * * *